United States Patent [19]

Clouser

[11] Patent Number: 4,570,847

[45] Date of Patent: Feb. 18, 1986

[54] FLUE DAMPER CONTROL SYSTEM

[75] Inventor: Michael T. Clouser, Indianapolis, Ind.

[73] Assignee: Emhart Industries, Inc., Indianapolis, Ind.

[21] Appl. No.: 664,249

[22] Filed: Oct. 24, 1984

[51] Int. Cl.[4] ..... F23L 11/00

[52] U.S. Cl. ..... 236/1 G; 126/285 B; 318/436

[58] Field of Search ..... 236/1 G; 126/285.5, 126/285 B; 431/20; 251/133, 134, 136; 318/436, 437, 672, 673, 467

[56] References Cited

U.S. PATENT DOCUMENTS

| | | | |
|---|---|---|---|
| 2,155,642 | 4/1939 | Dewey | 236/1 G |
| 3,914,676 | 10/1975 | Madonian et al. | 318/673 X |
| 4,185,770 | 1/1980 | Nagel | 236/1 G |
| 4,239,477 | 12/1980 | Hayes | 236/1 G X |
| 4,299,554 | 11/1981 | Williams | 431/20 X |

*Primary Examiner*—Harry Tanner
*Attorney, Agent, or Firm*—Robert F. Meyer

[57] ABSTRACT

A control system is provided for controlling a flue damper in a furnace flue. The control system includes a voltage source, a thermostat, a gas valve, and means for moving the flue damper between a closed position and an open position. The moving means includes a timer driven by a motor with a specially wound coil assembly including a first winding and a second winding. The coil assembly further includes a first terminal, a second terminal and a center tap terminal. The control system manipulates the flue damper and heating system during three stages of operation. The flue damper is closed and the furnace is off at the beginning of stage one. The control system opens the flue and turns on the furnace during stage one. The flue damper remains open during stage two. The control system turns off the furnace and closes the flue damper during stage three.

13 Claims, 3 Drawing Figures

FLUE DAMPER CONTROL SYSTEM

This invention relates to a flue damper control system usable in a heating system and particularly to a system for controlling movement of a flue damper which is less expensive and more reliable than conventional control systems.

A flue damper is installed in the flue of a chimney or the like between a furnace and an outside environment. A flue damper control system is usable to move the flue damper from a flue-closed position to a flue-opened position whenever the furnace is turned on so that any exhaust fumes generated by the furnace can be conducted through the flue to the outside environment. One object of a flue damper is to conserve energy by providing an insulator or thermal barrier in the flue whenever the furnace is dormant and an open flue is not needed. After the furnace is deactivated the control system moves the flue damper to the flue-closed position to provide the insulator or thermal barrier in the flue.

Heretofore, flue damper control systems have included large power resistors, a triac with associated resistors, or a relay. A flue damper control system constructed using the foregoing elements is expensive. Furthermore, such a system is difficult to manufacture as a result of its typically complex design and the great number of electrical connections required. A flue damper control system designed to use a minimum of relatively inexpensive elements while providing reliable efficient operation would avoid the shortcomings of conventional flue damper control systems.

According to the present invention, a system for controlling a flue damper includes a voltage source, a thermostat, and means for moving the flue damper between a closed position and an open position. The moving means includes a timer driven by a motor with a specially wound coil assembly and means for coupling the motor to the voltage source, thermostat and the gas valve associated with the furnace.

The motor coil assembly includes a first winding, a second winding, a first terminal, a second terminal, and a center tap terminal. The voltage source includes a first potential and a second potential. The first winding is coupled to the first terminal and the center tap terminal of the motor coil assembly. The second winding is coupled to the second terminal and the center tap terminal of the motor coil assembly. The first and second terminals are coupled to the first potential of the voltage source through electrical connections of the timer. The center tap terminal is coupled to the second potential of the voltage source.

The control system manipulates the flue damper and heating system during three stages of operation. The flue damper is closed and the furnace is off at the beginning of stage one. The flue damper is opened during stage one. The control system causes the flue damper to remain open and turns on the furnace during stage two. The control system turns off the furnace and closes the flue damper during stage three.

A first energization path is provided for use in the first stage of operation to initiate movement of the flue damper toward its open position when the thermostatic means senses that the ambient temperature of the environment to be warmed has fallen below a threshhold level. The first energization path electrically connects the first potential of the voltage source to the first terminal of the motor coil assembly and includes the thermostatic means and a first current-interrupting switch coupled in series relation. The first switch is normally closed. The first energization path operates to set up an electromagnetic flux in the first winding during the first stage of operation to actuate the moving means to move the flue damper from its closed position toward its open position whenever the environment to be warmed is too cool.

In the second stage, a second energization path is provided to maintain the electromagnetic flux in the first winding. In this second stage, the already opened flue damper is caused to remain in its open position to allow exhaust fumes from the furnace to be vented to the outside surroundings. The second energization path electrically connects the first potential of the voltage source to the first terminal of the motor coil assembly and includes a second current-interrupting switch. The second switch is normally open during most of the first stage of operation and closed during all of the second stage of operation.

In the second stage, a third energization path is also provided to set up an electromagnetic flux in the second winding to counteract and otherwise negate the electromagnetic flux in the first winding generated by the second energization path to disable the moving means to cause the flue damper to remain in its open position. The third energization path electrically connects the first potential of the voltage source to the second terminal of the motor coil assembly and includes the thermostatic means and a third normally open current-interrupting switch coupled in series relation.

The third energization path can further include the gas valve electrically connected to the first potential of the voltage source and to the second potential of the voltage source. The third switch is open during the first stage and is closed at the beginning of the second stage to set up the counteracting flux and turn on the gas valve. Operation of the gas valve turns on the furnace.

The third energization path is then disabled during a third stage of operation when the thermostatic means senses that the environment to be warmed is sufficiently warm. At that time, the thermostatic means will open to de-energize the gas valve to turn off the furnace and to remove the electromagnetic flux in the second winding. The electromagnetic flux created in the first winding is retained. The motor will then operate to move the flue damper toward its closed position.

The control system further includes means for sequentially actuating the first, second, and third energization paths to control movement of the flue damper. In the illustrative embodiment, the actuating means is a timer. The actuating means is coupled to the moving means. The sequential actuating means includes first cam means for selectively activating the first energization path to cause the flue damper to move toward its open position during the first stage of operation and means for selectively activating the second and third energization paths to stop movement of flue damper during the second stage of operation.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which.

Figure 1:
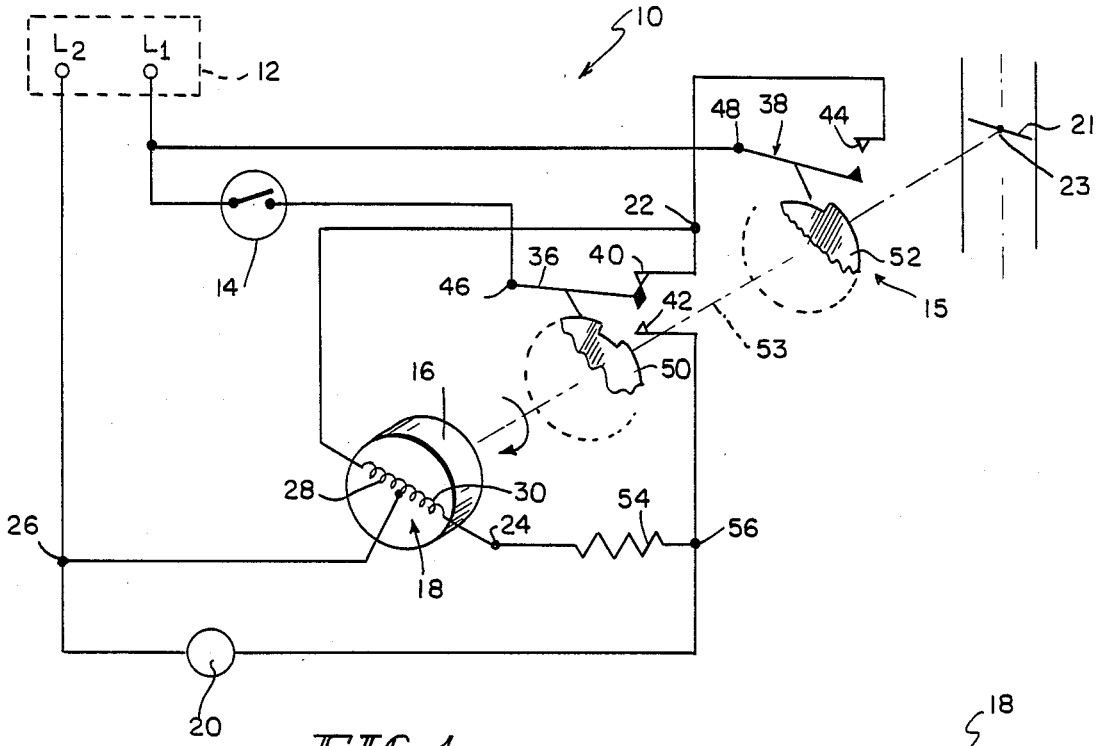
FIG. 1 is a schematic of a preferred embodiment of the control system of the present invention.
Figure 3:
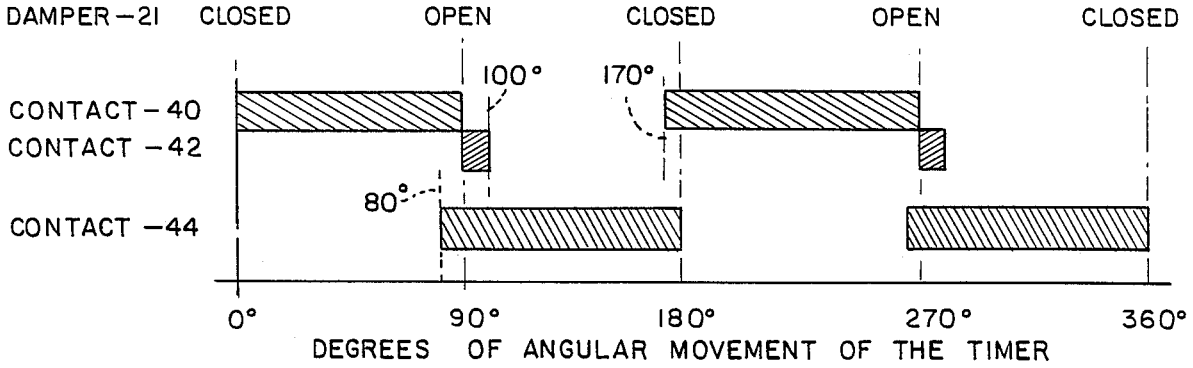
FIG. 3 is a time chart showing the operation of the three energizing path switches during consecutive first, second and third operating stage cycles.

Referring now to FIG. 1, a control system 10 of the present invention includes a voltage source 12, a thermostat 14, a timer 15, a timer motor 16, a motor coil assembly 18, and a gas valve 20 for actuating a furnace (not shown). The control system 10 is adaptable to any suitable flue damper system 21, even a system that is installed and operational, for use in a conventional heating system. In the illustrative embodiment the flue damper 21 is rotatable 360° about a pivot 23 in 90° increments. Therefore the damper continues to rotate in a single direction and goes through two open/closed cycles during each 360° rotation. These cycles and the degree of movement of the damper are shown in FIG. 3.

The control system 10 is designed to provide three stages of operation: a first stage during which the flue damper is opened, a second stage during which the flue damper is retained in its open position and the furnace is turned on, and a third stage during which the furnace is turned off and the flue damper is closed. The control system functions automatically due to the inclusion of the conventional thermostat 14 for sensing the temperature of the house or room to be warmed.

Figure 2:
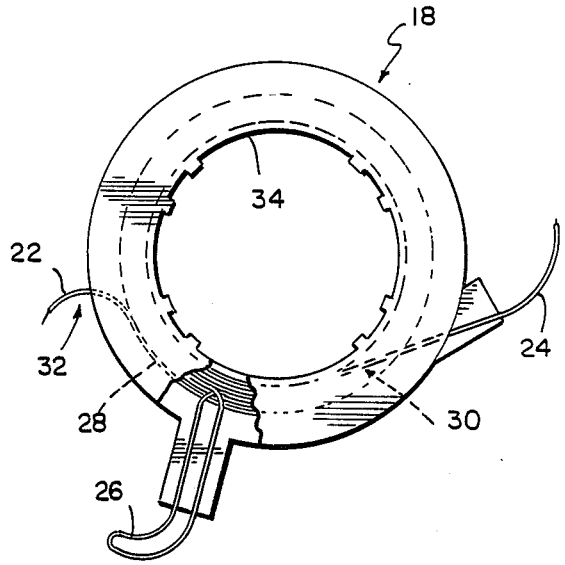
FIG. 2 is an enlarged detail view of the motor coil assembly employed in the control system of the present invention.

The motor coil assembly 18 includes a first terminal 22, a second terminal 24, a center tap terminal 26, a first winding 28, and a second winding 30. A suitable coil assembly is the M004 center tap bobbin winding available from Mallory Timer Company, Indianapolis, Ind. As shown best in FIG. 2, the first winding 28 and the second winding 30 are coiled in the same direction. The terminals 22, 24, and 26 as well as the windings 28 and 30 are constructed by wrapping an insulated wire 32 about a bobbin 34 as shown in FIG. 2. The voltage source 12 includes a first potential L1 and a second potential L2. The center tap terminal 26 of the motor coil assembly 18 is electrically connected to the second potential L2 of the voltage source 12.

The control apparatus 10 includes three energization paths which are described below. Operation of the energization paths is preferably dictated by the thermostat 14, the timer 15, a single pole double throw (SPDT) switch 36, and a single pole single throw (SPST) switch 38. The SPDT switch 36 includes a top contact 40 and a bottom contact 42 while the SPST switch 38 includes only a single contact 44.

The first energization path includes the thermostat 14 and the SPDT switch 36. The first energization path provides a primary circuit for energizing the first winding 28 of the motor coil assembly 18. One terminal of the normally-open thermostat 14 is electrically connected to the first potential L1 of the voltage source 12. The other terminal of the thermostat 14 is electrically connected to base terminal 46 of the SPDT switch 36. The top contact 40 is electrically connected to the first terminal 22 of the motor coil assembly 18. Thus defined, the first energization path couples the first potential L1 of the voltage source 12 to the first terminal 22 of the motor coil assembly 18.

The second energization path includes the SPST switch 38. The second energization path provides a secondary or alternate circuit for energizing the first winding 28 of the motor coil assembly 18 and is used during disablement of the primary first winding energizing circuit. Base terminal 48 of the SPST switch 38 is electrically connected to the first potential L1 of the voltage source 12. The single contact 44 of the SPST switch 38 is electrically connected to the first terminal 22 of the motor coil assembly 18 to fully define the second energization path.

The third energization path includes the thermostat 14, the SPDT switch 36, and the gas valve 20. The third energization path provides a circuit for energizing the second winding 30 of the motor coil assembly 18. The one terminal of the normally-open thermostat 14 is electrically connected to the first potential L1 of the voltage source 12. The other terminal of the thermostat 14 is electrically connected to base terminal 46 of the SPDT switch 36. The bottom contact 42 is electrically connected to the second terminal 24 of the motor coil assembly 18. One terminal of the gas valve 20 is electrically connected to the bottom contact 42 of the SPDT switch 36 and the other terminal of the gas valve is electrically connected to the second potential L2 of the voltage source 12.

The timer 15 includes a first cam 50 and a second cam 52 that are mounted on a shaft 53 that is coupled to timer motor 16 to govern the manipulation of the switches 36 and 38 as diagrammatically shown in FIG. 1. In a preferred embodiment, an M400 timer manufactured by Mallory Timers Company is driven by the M004 center tap motor also manufactured by Mallory Timers Company. The profile of each cam 50, 52 is described in the timing chart shown in FIG. 3. A one watt resistor 54 is inserted in the circuit as shown in FIG. 1 and functions as a current-limiting device to protect the timer motor 16 and effect a cooler coil operation temperature.

Referring now to the schematic in FIG. 1 and the time chart in FIG. 3, the operation of the flue damper control apparatus 10 of the present invention may be described as follows. The flue damper is movable around a circular path to open and close the flue. The system is shown at 0° on the time chart to be initially at rest awaiting a call for heat from the thermostat 14. At 0° on the time chart the flue damper 21 is in its closed position. A call for heat is initiated when the thermostat 14 closes its normally open switch. The first energization path is made from the L1 potential, through the thermostat 14, through the top contact 40 of the SPDT switch, through the first winding 28, and through the center tap terminal 26 of the motor coil assembly 18 to the L2 potential. The path thus energized causes the timer motor 16 to start and to initiate movement of the flue damper and of the control cams 50 and 52. In the illustrative embodiment damper 21 is coupled to the shaft 53. It will be understood that a second high torque motor may actually be used to move the flue damper between its closed and its open position. Any conventional means, responsive to an instruction from the timer, may be used to actuate such a second motor without departing from the spirit of the present invention.

The timer motor 16 continues to run until the flue damper is moved to its fully open position at 90° on the time chart in FIG. 3. At approximately 80° on the time chart (representing 80° of angular movement of the damper 21), the normally open SPST switch 38 is closed by cam 52 and an alternate second energization path is made from the L1 potential through SPST switch 38, through the first winding 28, and through the center tap terminal 26 to the L2 potential. The institution of the second energization path ends the first stage of operation.

The second stage of operation begins at approximately 90° on the time chart when the first cam 50 causes the top contact 40 of the SPDT switch 36 to break and the bottom contact 42 of the SPDT switch 36 to close. This switching action disrupts the first energization path and simultaneously sets up the third energization path from the L1 potential, through the thermostat 14, and through the SPDT switch 36 to point 56 on the schematic. From point 56, there are two electrical subpaths, one from point 56 through the resistor 54 and the second winding 30 to the L2 potential and the other from point 56 through the gas valve 20 to the L2 potential. The first subpath sets up an electromagnetic flux in the second winding 30 of sufficient size and phase to cancel and otherwise counteract the electromagnetic flux set up in the first winding 28 by the second energization path. Cancellation of the motor flux causes the shaft 53 to stop rotating. The second subpath described above causes the gas valve 20 or the like to become energized and allows a heat cycle to commence in the furnace. Therefore, the second operating stage ends with a heat cycle initiated and the flue damper at its open position to permit flue exhaust to be conducted therepast to the outside environment.

The third stage of operation begins at approximately 100° on the time chart as the first cam 50 causes the bottom contact 42 of the SPDT switch 36 to break. At about 170° on the time chart the first cam 50 causes the top contact 40 of the SPDT switch 36 to close. However, in this instance no energization path is set up since the thermostat 14 is open due to the warm climate in the environment to be heated. This action "sets" the control apparatus 10 for the next call for heat. At approximately 180° or the flue closed position, the single contact 44 of the SPST switch 38 breaks and interrupts the second energization path. This switching action causes the motor to stop and the cams 50, 52 to stop rotating. At this point, the flue damper is closed and the system is returned to its initial condition. Due to cam symmetry, two heat cycles are accommodated for each 360° rotation of the timer 15, operating cams 50 and 52, and flue damper 21.

Although the invention has been described in detail with reference to certain preferred embodiments and specific examples, variations and modifications exist within the scope and spirit of the invention as described and defined in the following claims.

What is claimed is:

1. A control system for controlling a flue damper in the flue of a furnace, the control system comprising a voltage source having a first and second potential, thermostatic means for sensing ambient temperature, the thermostatic means including a switch operable in response to sensed ambient temperature, a motor for moving the flue damper between a closed position and an open position, the motor including a motor coil assembly having a first terminal, a second terminal, a center tap terminal, a first winding coupled to the first terminal and the center tap terminal, and a second winding coupled with the second terminal and the center tap terminal, first energization path means for coupling the first potential of the voltage source to the first terminal of the motor coil assembly to set up an electromagnetic flux in the first winding to actuate the motor to move the flue damper from its closed position toward its open position, second energization path means for coupling the first potential of the voltage source to the first terminal of the motor coil assembly to maintain the electromagnetic flux in the first winding, a third energization path means for coupling the first potential of the voltage source to the second terminal of the motor coil assembly to set up an electromagnetic flux in the second winding, and means for actuating at least one of the first, second, and third energization path means to control movement of the flue damper, the actuating means including means for selectively activating the first energization path means to cause the flue damper to move toward its open position, and means for selectively activating the second and third energization path means to set up an electromagnetic flux in each of the two windings of the motor coil assembly so that said fluxes counteract one another thereby disabling the motor to stop movement of the flue damper.

2. The control system of claim 1 wherein the first energization path means includes, in series, the thermostatic means and a first path switch for interrupting the flow of current through the first energization path means.

3. The control system of claim 1 wherein the second energization path means includes a second path switch for interrupting the flow of current through the second energization path means.

4. The control system of claim 1 wherein the third energization path means includes, in series, the thermostatic means and a third path switch for interrupting the flow of current through the third energization path means.

5. The control system of claim 4 wherein the third energization path means further includes a gas valve coupled to the third path switch and the second potential of the voltage source so that activation of the third energization path means energizes the gas valve to operate the furnace.

6. The control system of claim 2 wherein the third energization path includes a third path switch for interrupting the flow of current through the third energization path means, and the control system further includes switch means for simultaneously operating the first and third path switches to cause the first path switch to be closed whenever the third path switch is open and the first path switch to be open whenever the third path switch is closed.

7. A control system for controlling a flue damper in a flue of a furnace, the control system comprising a voltage source having a first potential and a second potential, thermostatic means for sensing the ambient temperature of a volume to be warmed, means for moving the flue damper between a closed position and an open position, the moving means including a motor coil assembly having a first terminal, a second terminal, a center tap terminal coupled to the second potential of the voltage source, a first winding in communication with the first terminal and the center tap terminal, and a second winding in communication with the second terminal and the center tap terminal, first circuit means, responsive to the thermostatic means for activating the moving means, the first circuit means incuding first coupling means for coupling the first motor coil terminal to the first potential of the voltage source to energize the first winding and the moving means to cause the flue damper to move from its closed position toward its open position, second circuit means for retaining the flue damper substantially in its open position during operation of the furnace, the second circuit means including second coupling means for coupling the first motor coil terminal to the first potential of the voltage source to maintain an electromagnetic flux in the first winding, and third coupling means for coupling the second motor coil terminal to the first potential of the voltage source to set up an electromagnetic flux in the second winding to counteract the electromagnetic flux in the first winding to disable the moving means so that the flue damper is stationary.

8. The control system of claim 7 further comprising means for sequentially activating the first coupling means, the second coupling means and the third coupling means to regulate movement of the flue damper during a heating cycle of the furnace.

9. The control system of claim 8 wherein the first coupling means includes, in series, said thermostatic means, first switch means for selectively allowing current to flow through the first winding of the moving means such that operation of the first switch means energizes the first winding to operate the moving means causing the flue damper to be moved toward its open position when the ambient temperature of the volume to be warmed is below a preselected value.

10. The control system of claim 9 wherein the second coupling means includes a second switch means for selectively allowing current to flow through the first winding of the moving means such that operation of the second switch means maintains an electromagnetic flux in the first winding when the primary first winding energizing circuit is disabled.

11. The control system of claim 10 wherein the third coupling means includes, in series, said thermostatic means, a third switch means for selectively allowing current to flow through the second winding of the moving means such that operation of the third switch means sets up an electromagnetic flux in the second winding.

12. The control system of claim 11 wherein the third coupling means further includes a furnace valve coupled to the third switch means and the second potential of the voltage source so that operation of the third switch means energizes the furnace valve to operate the furnace.

13. A control system for controlling a flue damper in the flue of a furnace, the control system comprising a voltage source having a first and second potential, thermostatic means for sensing ambient temperature, the thermostatic means including a switch operable in response to sensed ambient temperature, a motor for moving the flue damper between a closed position and an open position, the motor including a motor coil assembly having a first terminal, a second terminal, a center tap terminal, a first winding coupled to the first terminal and the center tap terminal, and a second winding coupled with the second terminal and the center tap terminal, first energization path means for coupling the first potential of the voltage source to the first terminal of the motor coil assembly to set up an electromagnetic flux in the first winding to actuate the motor to move the flue damper from its closed position toward its open position, the first energization path means including, in series, the thermostatic means and a first path switch for interrupting the flow of current through the first energization path, second energization path means for coupling the first potential of the voltage source to the first terminal of the motor coil assembly to maintain the electromagnetic flux in the first winding, the second energization path means including a second path switch for interrupting the flow of current through the second energization path, a third energization path means for coupling the first potential of the voltage source to the second terminal of the motor coil assembly to set up an electromagnetic flux in the second winding, the third energization path means including, in series, the thermostatic means and a third path switch for interrupting the flow of current through the third energization path means, and means for actuating at least one of the first, second, and third energization path means to control movement of the flue damper, the actuating means including means for selectively actuating the first energization path means to cause the flue damper to move toward its open position, and means for selectively activating the second and third energization path means to set up an electromagnetic flux in each of the two windings of the motor coil assembly so that said fluxes counteract one another thereby disabling the motor to stop movement of the flue damper.

* * * * *